US005707191A

United States Patent [19]

Hempfling et al.

[11] Patent Number: 5,707,191

[45] Date of Patent: Jan. 13, 1998

[54] STRESS PLATE WITH ANGLED HOLE

[75] Inventors: Dave C. Hempfling, Chicago; Riaz Hasan, Palatine, both of Ill.

[73] Assignee: Illinois Tool Works Inc., Glenview, Ill.

[21] Appl. No.: 766,799

[22] Filed: Dec. 13, 1996

[51] Int. Cl.[6] ..... F16B 21/18; F16B 43/00

[52] U.S. Cl. ..... 411/533; 411/437; 411/545; 411/526

[58] Field of Search ..... 411/174, 175, 411/433, 437, 525, 526, 527, 533, 545

[56] References Cited

U.S. PATENT DOCUMENTS

| | | | |
|---|---|---|---|
| 2,169,182 | 8/1939 | Kost | 411/437 |
| 2,824,480 | 2/1958 | Hotchkin | 411/437 |
| 3,108,371 | 10/1963 | Munse | 411/437 X |
| 4,201,111 | 5/1980 | Kuttler | 411/527 X |
| 4,361,997 | 12/1982 | DeCaro | 52/512 |
| 4,380,413 | 4/1983 | Dewey | 411/161 |
| 4,453,361 | 6/1984 | Hulsey | 52/410 |
| 4,508,477 | 4/1985 | Oehlke et al. | 411/174 |
| 4,518,293 | 5/1985 | Pleickhardt et al. | 411/527 X |
| 4,693,654 | 9/1987 | Bettini | 411/387 |
| 4,781,503 | 11/1988 | Bogel | 411/368 |
| 4,809,568 | 3/1989 | DeCaro | 81/57.37 |
| 4,907,927 | 3/1990 | Choiniere | 411/368 |
| 5,102,275 | 4/1992 | Hulsey | 411/134 |
| 5,122,022 | 6/1992 | Kluser | 411/446 |
| 5,378,102 | 1/1995 | Mossman | 411/531 |
| 5,517,883 | 5/1996 | Goil et al. | 81/57.37 |

FOREIGN PATENT DOCUMENTS

| | | | |
|---|---|---|---|
| 21133 | 6/1971 | Japan | 411/527 |

*Primary Examiner*—Neill R. Wilson

*Attorney, Agent, or Firm*—Mark W. Croll; Thomas W. Buckman; John P. O'Brien

[57] ABSTRACT

A stress plate for use with a threaded fastener for securing relatively soft insulation to a solid base, such as in a roofing environment, includes a generally planar main body, and a hole on the main body configured for receiving the fastener. The plate is configured so that the hole is angled relative to a vertical axis of the plate for accommodating threads of the fastener so that the fastener is maintained in a generally perpendicular orientation to the main body upon the engagement of the threads of the fastener in the hole. In the preferred embodiment, the threads of the fastener have a helix angle, and the hole, which is formed in a conical depression in the plate, is angled at the same angle as the threads of the fastener.

6 Claims, 2 Drawing Sheets

STRESS PLATE WITH ANGLED HOLE

BACKGROUND OF THE INVENTION

The present invention relates generally to fastening systems for use in securing relatively soft insulation to a solid base, and specifically, to stress plates and associated threaded fasteners used for securing insulation and membranes to a building structure.

In certain modem roofing installations or commercial and factory buildings having a flat roof design, a layer of insulation is placed on a generally corrugated steel roof deck and is then covered with a single ply thermoplastic roofing membrane to protect against the elements. Conventional membranes are single ply and are made of plastics such as EPDM, PVC or equivalent materials.

The assemblies typically used to secure the insulation generally include a washer-like stress plate made of either plastic or metal which receives a screw-like fastener that is threaded into the roof deck, clamping the insulation between the stess plate and the roof deck. Since the type of insulation commonly utilized is approximately up to six or even twelve inches thick, it is important to keep the fastener in perpendicular alignment when installing the plate so that the stress plate properly contacts and secures the insulation against blowing off from extreme cyclical loading. Adverse weather conditions such as hurricanes end other storms having high and gusting winds create the extreme high pressure dynamic loading, including uplift, of the sort which such roofing is designed to withstand. In practice, special tools may be used to install the washers and fasteners. An example of such a tool is described in U.S. Pat. No. 4,809,568, and another such tool is sold by ITW Buildex, Itasc Ill. under the mark ACCUFAST.

In a typical installation, the stress plates and fasteners are delivered to the jobsite in separate packages. Next, the installer obtains a supply of plates and fasteners, and lays out the plates on the roof in a specific pattern required by the roofing approval or warranty. Upon completion of that step, the installer installs fasteners through the plates, into the insulation and/or membrane, and eventually into the solid roof base or substrate.

A disadvantage of this method of installation is that it requires the installer to spend a significant amount of time to perform the two major steps of separately handling the stress plates and the fasteners. Also, once installed, the alignment of the fasteners relative to the plates and the roof must be maintained under relatively exposed working conditions. Often it is difficult to prevent the fasteners from being threaded into the roof at an angle, which may detract from their ability to secure the roof when exposed to severe weather.

Thus, it is a first object of the present invention to provide an improved stress plate which is specially designed to hold the fastener at a perpendicular orientation to the roof while it is being installed.

Another object of the present invention is to provide an improved stress plate in which an opening or hole in tho plate is oriented at an angle which corresponds to the helix angle of the threads of the fastener used to secure it to the roof.

Still another object of the present invention is to provide an improved fastener assembly for use in securing relatively soft materials to a solid base, such assembly including a stress plate and a fastener preinstalled into the plate and hold relative thereto at a perpendicular angle to facilitate proper installation.

SUMMARY OF THE INVENTION

The above-identified objects are met or exceeded by the present stress plate for use with a threaded fastener in attaching a roofing membrane to a roof. A major feature of the stress plate is that the hole which accommodates the fastener is configured to retain the fastener in a perpendicular orientation to the plate, and ultimately, to the roof. In the preferred embodiment, the threads of the fastener have a helix angle, and the hole is angled at the same angle as the threads of the fastener to maintain this perpendicular orientation. In addition, the present plate is preferably provided to the installer as an assembly with the fastener threaded into the hole in the plate.

More specifically, a stress plate for use with a threaded fastener for securing relatively soft insulation to a solid base, such as in a roofing environment, includes a generally planar main body, and a hole on said main body configured for receiving the fastener. The plate is configured so that the hole is angled relative to a vertical axis of the plate for accommodating threads of the fastener so that the fastener is maintained in a generally perpendicular orientation to the main body upon the engagement of the threads of the fastener in the hole.

DESCRIPTION OF THE PREFERRED EMBODIMENT

Figure 1:
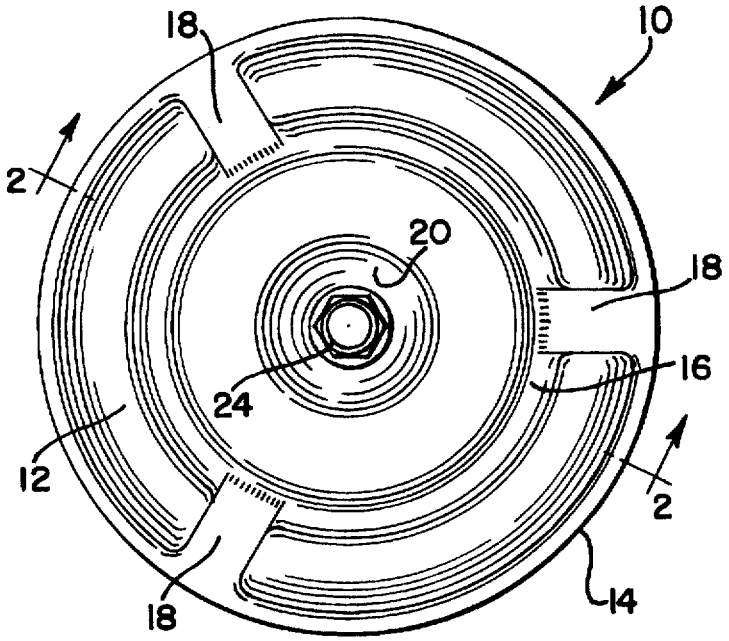
FIG. 1 is an overhead plan view of the present stress plate having a fastener engaged therein.
Figure 2:
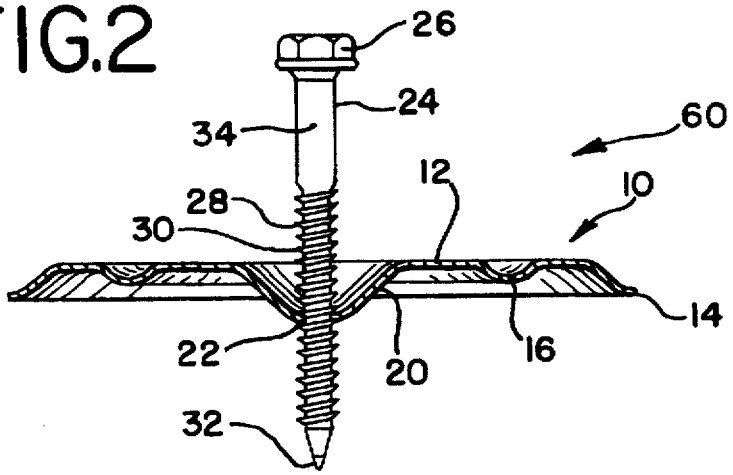
FIG. 2 is a sectional view taken along the line 2—2 of FIG. 1 and in the direction indicated generally.
Figure 3:
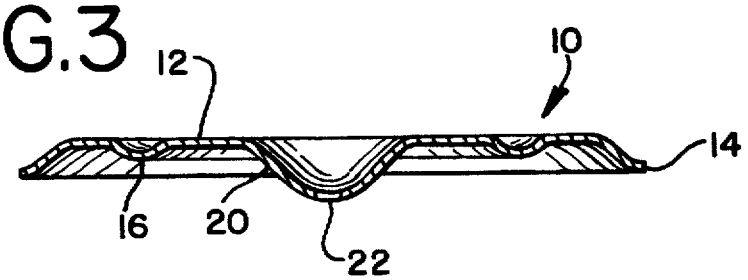
FIG. 3 is a view of the stress plate as depicted in FIG. 2 with the fastener omitted.

Referring now to FIGS. 1–3, a stress plate incorporating the features of the invention is shown and generally designated 10. The plate 10 is relatively rigid, and is made of either metal or plastic, as is well known in the art. In the pictured embodiment the plate 10 is made of metal, is circular in shape and has a 3.0 inch diameter, however other shapes and sizes are contemplated including oval, square and triangular, depending on the application.

The plate 10 includes a main body 12 with an outer peripheral edge 14 and at least one strengthening corrugation 16, pictured as an annular ring stamped into the surface of the main body 12, which is genially planar. The outer peripheral edge 14 is vertically spaced from the main body 12 to define a declining outer rim. In the preferred embodiment, the corrugation 16 may also be provided with three additional radial rib segments 18 which connect the corrugation 16 with the peripheral edge 14.

A generally conically-shaped depression 20 is preferably positioned centrally on the main body 12, and is of sufficient depth to allow the top of the head of the fastener to be below the top of the rib on the plate. If other fasteners are used, such as those having flat heads, the flat head is preferably located on the main body 12, and the depression 20 is not required.

A generally centrally located opening or hole 22 is defined by the depression 20 and is configured for receiving a fastener 24. In the preferred embodiment, the hole 22 is positioned on a central or vertical axis of both the depression and the plate 10. The size or diameter of the hole 22 will vary with the application and the size of the fastener; however, in the preferred embodiment, the fastener 24 is a No. 12 size, and the hole 22 is in the general range of 0.129 to 0.135 inch.

Referring now to FIG. 2, the fastener 24 is preferably a screw with a hex head 26 at one end, a threaded portion 28 made up of a plurality of helical threads 30, a tip 32 opposite the head 26 and with the threaded portion 28 between the head and tip, and a shank 34 between the head and the threaded portion. In the preferred embodiment, the tip 32 is of a self-tapping configuration and preferably is of the type disclosed in commonly assigned U.S. Pat. No. 4,693,654, which is incorporated by reference. In the preferred embodiment, the threads 30 are in the modified buttress form, and are coated with an environmentally resistant protective coating. Furthermore, the fasteners 24 may be provided in any suitable length depending on the application. It is contemplated that the fasteners may fall within the range of 1.5 to 14 inches in length. Suitable fasteners are manufactured and sold by ITW Buildex, Irasca, Ill., under the trademark HBXTRA.

Figure 4:
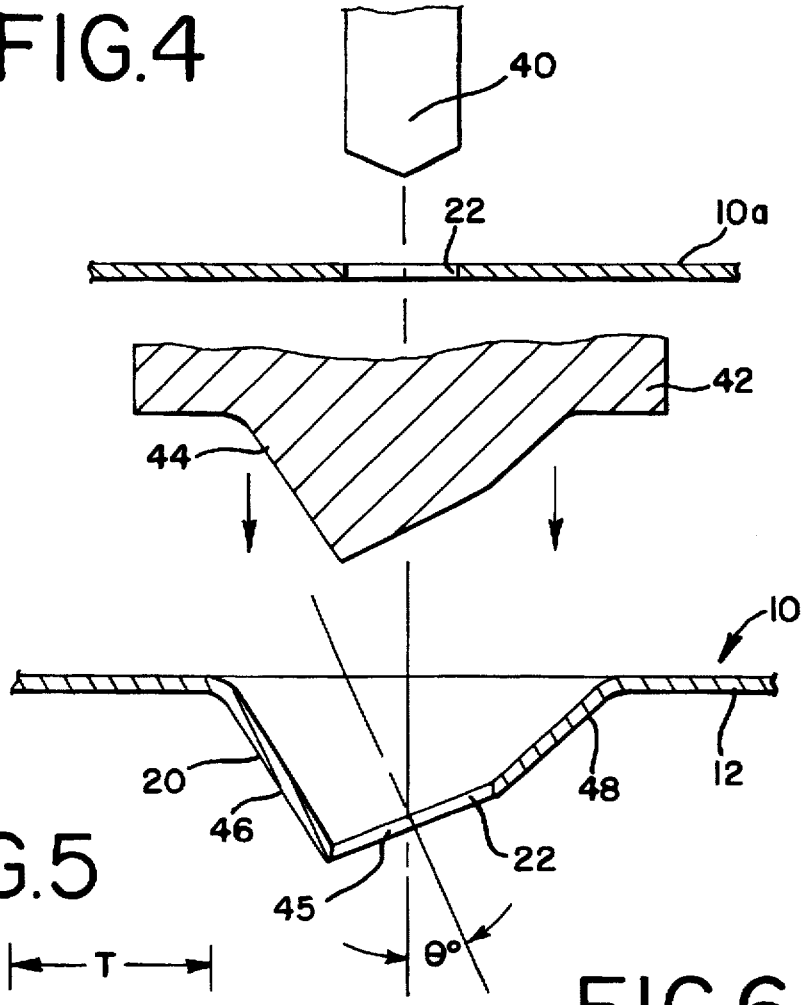
FIG. 4 is an exploded schematic representation of the process of fabricating the stress plate of FIG. 3.
Figure 5:
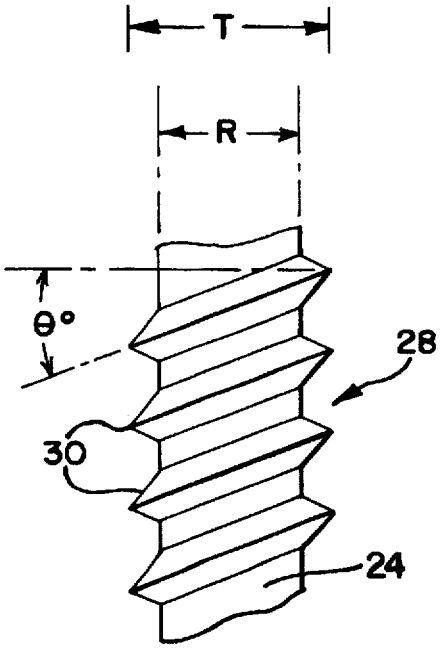
FIG. 5 is a fragmentary enlarged elevational view of the fastener shown in FIG. 2.
Figure 6:
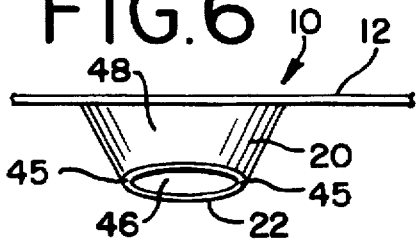
FIG. 6 is a side elevational view of the portion of the present stress plate depicted in FIG. 4.

Referring now to FIGS. 4–6, an important feature of the present stress plate 10 is that the hole 22 is angled relative to a vertical axis of the plate for accommodating the threads 30 of the fastener 24 so that, upon the engagement of the threads 30 in the hole 22, the fastener is maintained in a generally perpendicular orientation to the plane defined by the main body 12. In the preferred embodiment, the hole 22 is disposed in the depression 20 at an angle θ to the vertical axis of the depression, and the angle θ is the same as the angle of the threads, also known as the helix angle. By angling the hole 22 in this manner, the fastener 24 is more tightly maintained in the hole, and is also maintained in a perpendicular orientation, which facilitates proper installation. While the exact angular orientation of the hole 22 will vary with the application and the type of fastener, in the preferred embodiment, the angle θ, which is also the helix angle of the screw, is in the range of 8° .

More specifically, the threads 30 are formed in a helix, while the hole 22 in the plate 10 is planar. Accordingly, on one side of the screw 24 the wall of the hole 22 is nested, or positioned between the threads, and the inner diameter of the plate abuts the inner diameter, or root of the fastener. On the opposite side, the relative angular difference between the wall of the plate 10 and the thread is 2 times θ and in the opposite direction, with respect to horizontal, and the thread cuts through the plate. This cutting of the plate 10 forces the screw 24 against the first side of the plate, thus maintaining the perpendicularity of the screw with respect to the plate.

Referring now to FIG. 4, the manner of manufacturing the plate 10 is described in schematic detail. Initially, a hole punch 40 creates the hole 22 in the sheet of metal 10*a* which will eventually become the plate 10. Next, a stamping die 42 having a generally conical shape with an offset or angled base formation 44 creates the angled shape of the depression 20. Other portions of the die 42 (not shown) create the strengthening formations 16, 18 simultaneously with the creation of the depression 20.

To achieve the desired perpendicular relationship between the fastener 24 and the hole 22, the angled base formation 44 is machined at the same angle θ as is the helix angle of the threads 30. Referring now to FIG. 6, a fragmentary side view of the plate 10 is depicted, and the angled nature of the opening 22 is seen. The creation of the opening 22 defines a first or long side 46 and a second or short side 48 of the depression 20. It will be appreciated however, that the depression 20 and the opening 22 need not be formed as shown. The short side 48 may be eliminated, and the "upper" end of opening 22 shown on the fight side of FIG. 4 may abut the planar main body 12, and still achieve the desired helix angle of the opening 22.

Referring now to FIG. 5, a fragmentary enlarged side view of the threaded portion 28 of the fastener 24 is shown. The fastener 24 has a root diameter R and a wider thread diameter T. Also, as described above, the threads 30 are oriented at a helix angle θ, which is the same as the angle of orientation of the hole 22. In the preferred embodiment when the fastener 24 is threadably engaged in the hole 22, one side wall 45 between the short side 48, and the long side 46, will engage the outer diameter T and the other side wall 45 will nest within the root diameter R. Through this engagement, the fastener 24 is maintained in a substantially vertical orientation, or perpendicular relative to the plane of the main body portion 12 of the plate 10.

Figure 7:
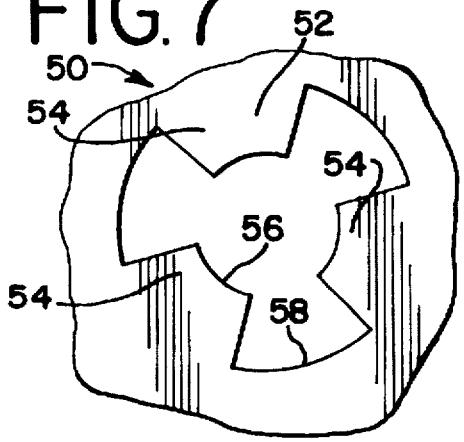
FIG. 7 is a fragmentary overhead plan view of an alternate embodiment of the stress plate depicted in FIG. 1.

Referring now to FIG. 7, an alternate embodiment of the stress plate 10 is fragmentarily shown and is generally designated 50. With the exception of the elements described presently, the structure of the stress plate 50 is identical to the plate 10 and is not shown. The main distinguishing feature of the plate 50 is that a conical depression 52 is at least partially defined by a series of annularly spaced tabs 54, which create the generally conical shape described above in relation to the depression 20.

As is the case with the plate 10, the plate 50 defines a central opening 56 which is angled at the same angle θ as is the opening 22, and corresponds to the helix angle of the fastener 24. In the pictured embodiment, the opening 56 has a diameter in the range of 0.129 to 0.135 inch, which may vary with the application and type of fastener. Thus, ends of the cabs 54 define the opening 56. Further, an outer diameter 58 of the depression 52 which defines the tabs 54 is in the preferred range of 0.220 to 0.225 inch, which also may vary with the application. The illustration of the plate 50 is intended to establish that the depression 20, 52 need not be continuous in construction to achieve the goal of maintaining the fastener 24 in a substantially upright position.

In operation, it is preferred that the fastener 24 and the plates 10, 50 be assembled prior to shipment to the jobsite to reduce the amount of work performed by the installer, and to simplify the installation procedure. A suitable assembly of fastener and plate is indicated generally in FIG. 2 and designated 60. The installer then carries a plurality of the assemblies 60 in a suitable container to the jobsite, places the individual assemblies in their appropriate locations on the roof and proceeds to drive the fasteners into the roof using a driver tool as is well known in the art. The advantage of the present stress plate 10, 50 is that the fastener 24 is maintained in a generally vertical position relative to the plate so that the fastener is properly driven into the solid base of the roof deck to properly position the stress plate for the proper amount of fastening power.

While various embodiments of the stress plate with angled hole of the invention have been shown and described, it will be appreciated by those skilled in the art that changes and modifications may be made thereto without departing from the invention in its broader aspects and as set forth in the following claims.

What is claimed is:

1. A stress plate for use with a threaded fastener for securing relatively soft insulation to a solid base, comprising:

a generally planar main body;

a hole on said main body configured for receiving the fastener, said hole being defined by a depression generally centrally formed in said main body, in defining said hole, said depression has a first side and a second side, said second side is shorter than said first side, said hole having first and second side walls, each located between said first and second sides, and wherein the fastener has a root diameter and the thread has an outer diameter, said first side wall engages the root diameter and said second side wall engages the outer diameter;

said hole being configured to be planar and angled relative to a vertical axis of said plate for accommodating threads of the fastener, said planar configuration and said engagement of said side walls with said fastener being such that the fastener is maintained in a generally perpendicular orientation to said main body upon the engagement of the threads of the fastener in said hole.

2. The stress plate as defined in claim 1 wherein the threads of the fastener have a helix angle, and said hole is angled at the same angle as the threads of the fastener.

3. The stress plate as defined in claim 1 wherein the angle of an axis of said hole is in the range of 8° relative to a vertical axis of said depression.

4. The stress plate as defined in claim 1 wherein a plurality of tabs on said plate have ends, and said hole is defined by ends of said tabs.

5. A fastener assembly for securing relatively soft insulation to a solid base, comprising:

a fastener having a head, a tip and a threaded portion located between said tip and said head;

a stress plate having a generally planar main body;

a generally central hole on said main body configured for receiving the fastener;

said hole being defined by a depression generally centrally formed in said main body, in defining said hole, said depression has a first side and a second side, said second side is shorter than said first side, said hole having first and second side walls, each located between said first and second sides and wherein the fastener has a root diameter and the thread has an outer diameter, said first side wall engages the root diameter and said second side wall engages the outer diameter;

at least one strengthening corrugation formed in said plate to surround said depression; and said plate being configured so that said hole is planar, yet angled relative to a vertical axis of said plate for accommodating said threaded portion of said fastener so that said fastener is maintained in a generally perpendicular orientation to said main body upon the engagement of said threaded portion of the fastener in said hole.

6. The stress plate as defined in claim 5 wherein said threaded portion includes a plurality of threads arranged at a helix angle, and said hole is angled at the same angle as said helix angle.

* * * * *